US010488149B2

(12) United States Patent
Tasyagan

(10) Patent No.: US 10,488,149 B2
(45) Date of Patent: Nov. 26, 2019

(54) SEMI-AUTOMATIC AIR RILE WITH PNEUMATIC SYSTEM

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 0 days.

(21) Appl. No.: 16/096,425

(22) PCT Filed: Jan. 10, 2017

(86) PCT No.: PCT/TR2017/050010
§ 371 (c)(1),
(2) Date: Oct. 25, 2018

(87) PCT Pub. No.: WO2017/196274
PCT Pub. Date: Nov. 16, 2017

(65) Prior Publication Data

US 2019/0120590 A1 Apr. 25, 2019

(30) Foreign Application Priority Data

May 9, 2016 (TR) ..... 2016/06084

(51) Int. Cl.
*F41B 11/62* (2013.01)
*F41B 11/73* (2013.01)
*F41A 5/26* (2006.01)

(52) U.S. Cl.
CPC ..... *F41B 11/62* (2013.01); *F41A 5/26* (2013.01); *F41B 11/73* (2013.01)

(58) Field of Classification Search
CPC ..... F41B 11/62; F41B 11/73; F41A 5/26
USPC ..... 124/56
See application file for complete search history.

(56) References Cited

U.S. PATENT DOCUMENTS

| | | | | |
|---|---|---|---|---|
| 5,429,034 | A | 7/1995 | Badali et al. | |
| 6,158,424 | A | 12/2000 | Kunimoto | |
| 8,191,543 | B2 * | 6/2012 | Masse | F41B 11/57 124/76 |
| 9,383,149 | B2 * | 7/2016 | Ricks | F41A 5/22 |
| 2009/0235911 | A1 | 9/2009 | Kunimoto | |

FOREIGN PATENT DOCUMENTS

| | | | |
|---|---|---|---|
| EP | 0634620 | A1 | 1/1995 |
| EP | 0922922 | A2 | 6/1999 |
| WO | 2007137587 | A1 | 12/2007 |

OTHER PUBLICATIONS

International Search Report in International application PCT/TR2017/050010, dated Apr. 25, 2017.
Written Opinion of the International Searching Authority in application PCT/TR2017/050010, dated Apr. 25, 2017.

* cited by examiner

*Primary Examiner* — Joshua E Freeman
(74) *Attorney, Agent, or Firm* — Mark M. Friedman

(57) ABSTRACT

This invention relates to a semi-automatic air rifle and air pistol with pneumatic system (PCP) operating in such a way that the air, which carries the ammunition in the pneumatic air rifles and air pistols, hits, without changing its direction, the piston at the instant it leaves the barrel to set said piston in motion towards the muzzle, and at the same time, the other members of the system that we have developed also start to move, thereby enabling, after each shot, the rifle and the pistol to become automatically prepared for the next shot.

1 Claim, 4 Drawing Sheets

SEMI-AUTOMATIC AIR RILE WITH PNEUMATIC SYSTEM

TECHNICAL FIELD

Figure 1:
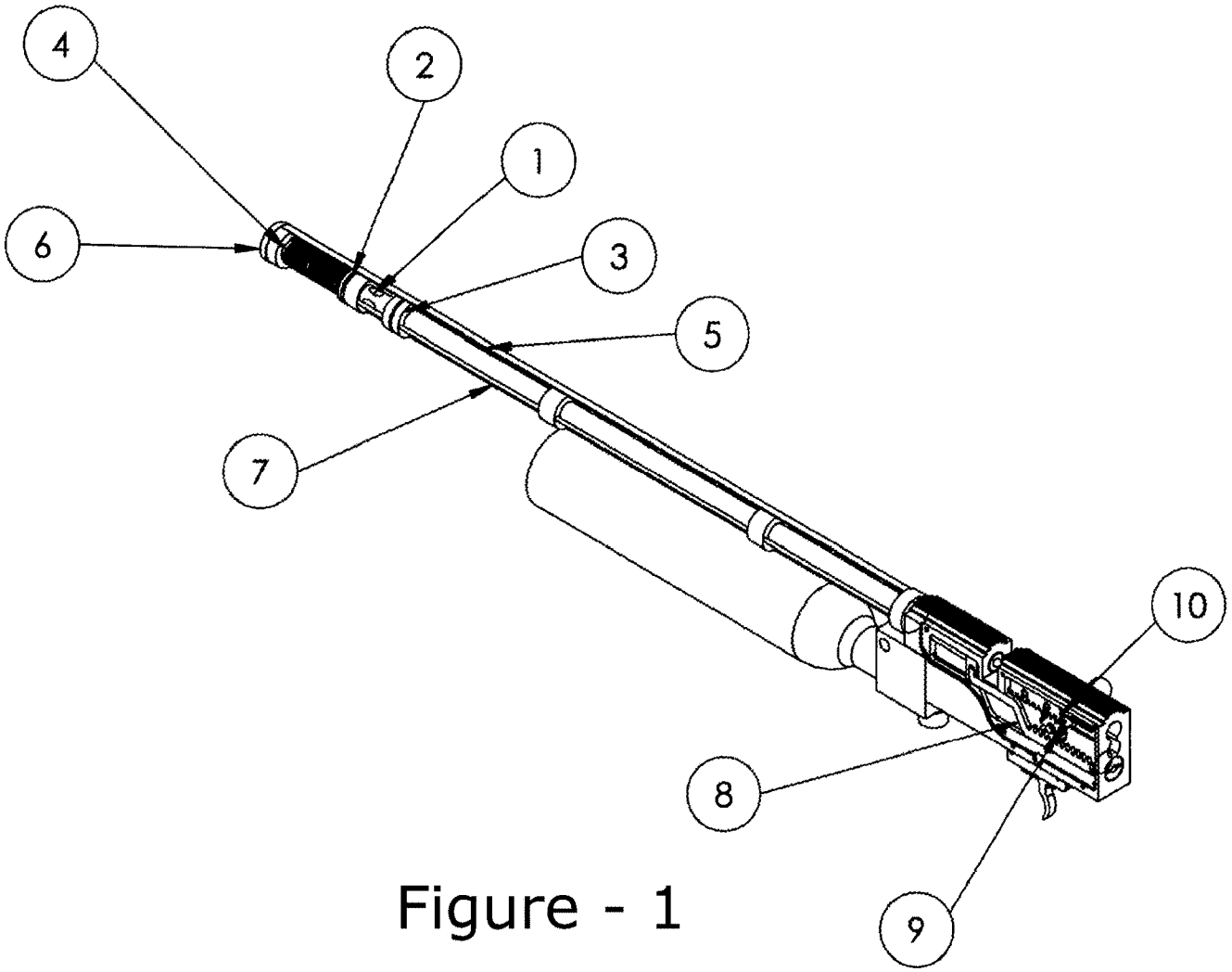

This invention relates to a semi-automatic air rifle and air pistol with pneumatic system (PCP) operating in such a way that the air, which carries the ammunition in the pneumatic air rifles and air pistols, hits, without changing its direction, the piston at the instant it leaves the barrel to set said piston in motion towards the muzzle, and at the same time, the other members of the system that we have developed also start to move, thereby enabling, after each shot, the rifle and the pistol to become automatically prepared for the next shot.

PRIOR ART

The currently available air rifles and air pistols operate based on the use of a break barrel or a pneumatic system (PCP).

As known, in a break barrel type air rifle and air pistol, the barrel is hinged at a certain point to enable the storage of the dry air in the rifle or pistol chamber. The ammunition is placed in the muzzle and the barrel is closed. In this way, the rifle or the pistol is enabled to switch into the shot position. When the trigger is pulled, the air stored in the chamber is pushed by means of the piston within the rifle or the pistol towards the barrel, enabling the ammunition placed in the barrel to be propelled from the barrel and to reach the target. These actions are repeated each time a shot is to be performed in this type of air rifle and air pistol.

The situation with the air rifles and air pistols with pneumatic system (PCP) is slightly different. In this type of air guns, the barrel is fixed. The rifle or the pistol operates by means of an air cylinder fitted on the gun. It is possible to perform the shots by separately placing each time the ammunition in the muzzle, while it is also possible to carry out successive shots by the use of a magazine. When the cocking lever is pulled backwards, the piece inside the rifle or the pistol referred to as the hammer also moves backwards and compresses the spring therein.

When the trigger is pulled, the compressed spring becomes released and the hammer rapidly moves to hit the pin on the air cylinder that is in front of said hammer. The valve on the cylinder opens to enable some amount of air to reach the barrel, thereby enabling the shot action to be completed.

In this type of weapons (rifles and pistols), it is necessary to manually pull back the cocking lever for every shot. This process continues until the ammunition inside the magazine is used up. The number of shots varies depending on the cylinder volume and the size of the ammunition used. When the air inside the cylinder has been consumed, the cylinder is recharged with air to bring the rifle or the pistol into the state ready for shot.

As known, according to these practices of the state of the art, it is necessary to break and reclose the barrel each time a shot is to be performed or it is necessary to pull pack and then drive forward the cocking lever prior to every shot in case a magazine is being used.

Some studies have been made in order to eliminate this situation. The semi-automatic rifle and pistol with pneumatic system (PCP) according to the invention have the quality of being complementary for these studies.

In the semi-automatic rifle and pistol with pneumatic system (PCP) according to the invention, the system is actuated by way of causing the idle air emerging from the muzzle to hit, without changing its direction, the piston and the air rifle and pistol are thus enabled to operate automatically. In this manner, the rifle or the pistol is still able to operate even in case the pressure of the air coming from the cylinder drops below the standards. This provides the users with the possibility of performing a greater number of shots as compared to the similar weapons.

BRIEF DESCRIPTION OF THE INVENTION

The object of this invention is to create the user satisfaction by way of enabling the rifle or the pistol to be automatically cocked and enabling the rifle or the pistol to automatically switch to a state ready for the second shot and subsequent shots after the first shot, wherein, according to the system we have developed, the idle air emerging from the muzzle following a shot is caused to hit, without changing its direction, the piston after the ammunition has left the barrel, thereby setting the piston in motion and wherein the other associated system members are enabled to operate in harmony.

DETAILED DESCRIPTION OF THE INVENTION

The semi-automatic air rifle and air pistol with pneumatic system (PCP) according to the invention operate in a manner different from their counterparts. Whereas the similar weapons utilize the pressure generated by the air leaving the muzzle in order to enable said weapons (rifles or pistols) to operate automatically, the rifle and pistol we have developed involves the automatic operation of said rifle or pistol by way of causing the air, which carries the ammunition, to directly hit the piston without any change in the direction of said air, thus moving the piston in the direction of air, and actuating also the other associated members. It is sufficient to cock the weapon only once prior to the shot in order to enable the operation of the rifle or the pistol. For the subsequent shots, it will be sufficient to simply pull the trigger. The reason for this is that the rifle or the pistol attains a state ready for the next shot after each shot, owing to the system we have developed.

When forming the air rifle and air pistol with pneumatic system according to the invention, the power of the idle air, which leaves the muzzle and mixes into the atmosphere following a shot, has been utilized. According to the rifle and the pistol we have developed, a system is disposed at the muzzle wherein once the ammunition has left the barrel, the idle air that follows said ammunition is caused to directly hit, without changing its direction, the piston that is situated in front of the same, thereby using said air in the automatic cocking of the mechanism of the rifle or the pistol.

The semi-automatic air rifle or air pistol with pneumatic system (PCP) according to the invention is illustrated in the appended drawings in order to enable a better understanding of the same. In these drawings;

FIG. 1: An overall view of the semi-automatic air rifle and air pistol with pneumatic system (PCP)

Figure 2:
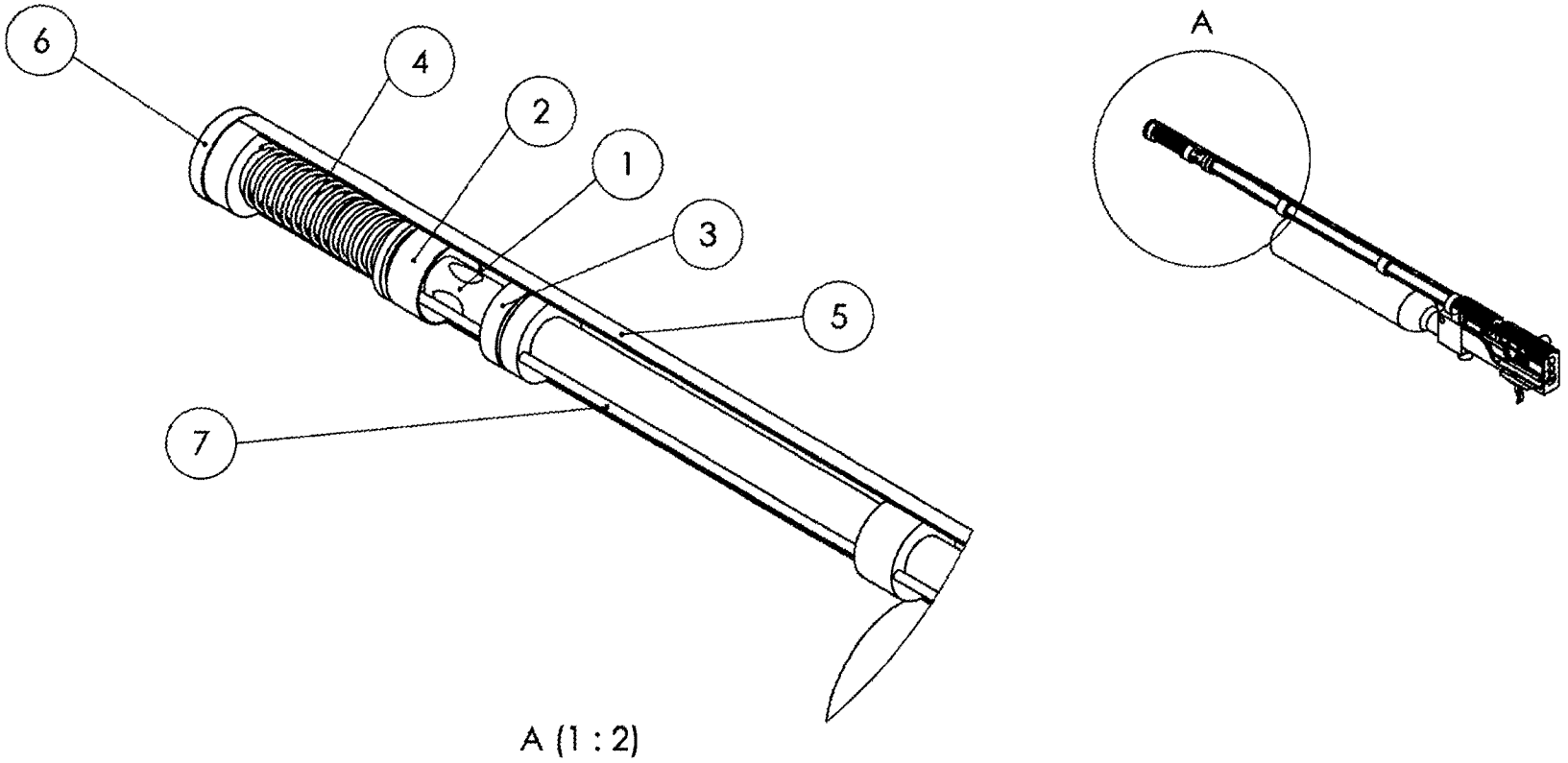

FIG. 2: A view of the system positioned at the muzzle of the semi-automatic air rifle and air pistol with pneumatic system (PCP)

Figure 3:
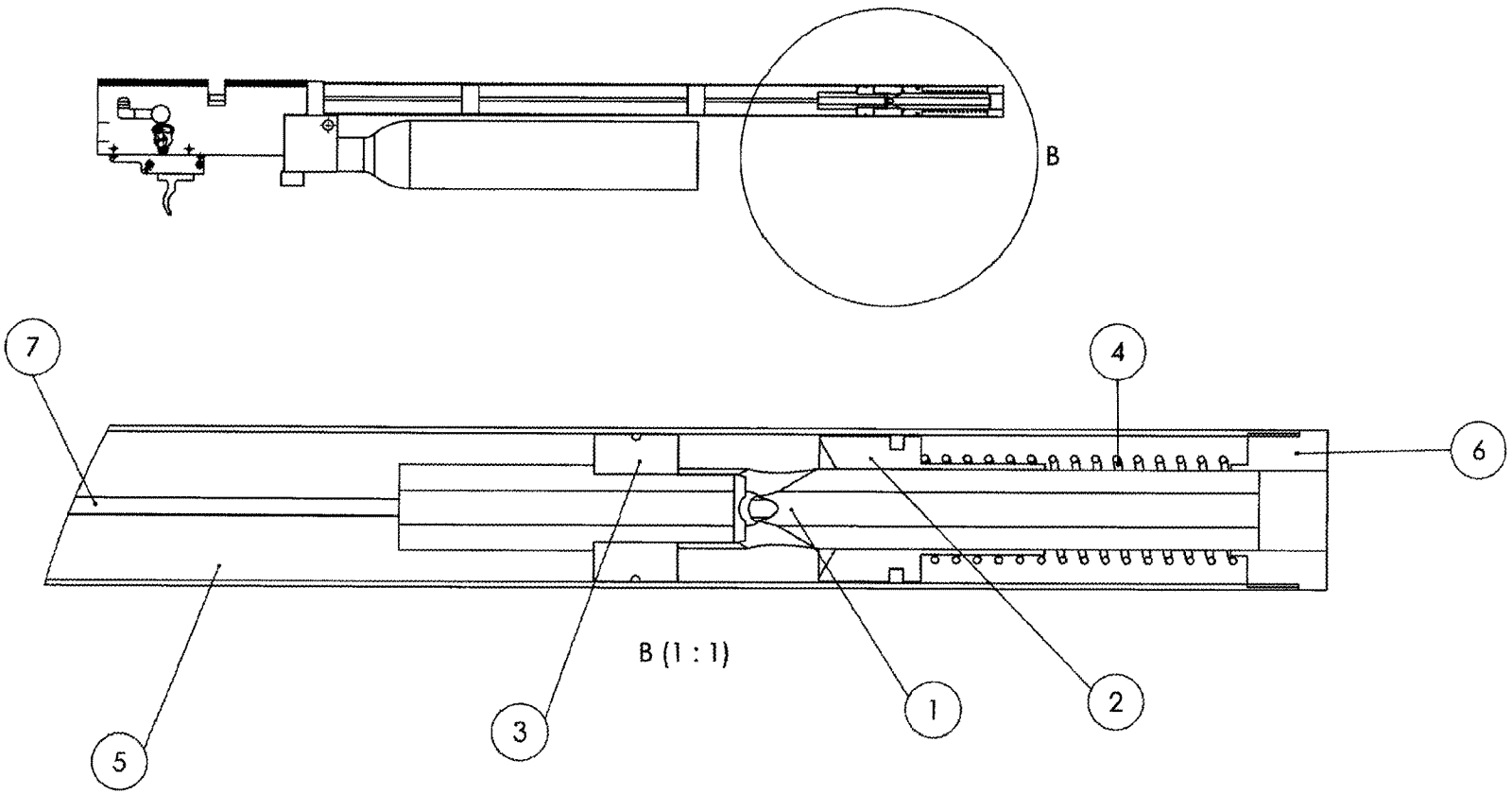

FIG. 3: A cross-sectional view of the system positioned at the muzzle of the semi-automatic air rifle and air pistol with pneumatic system (PCP)

Figure 4:
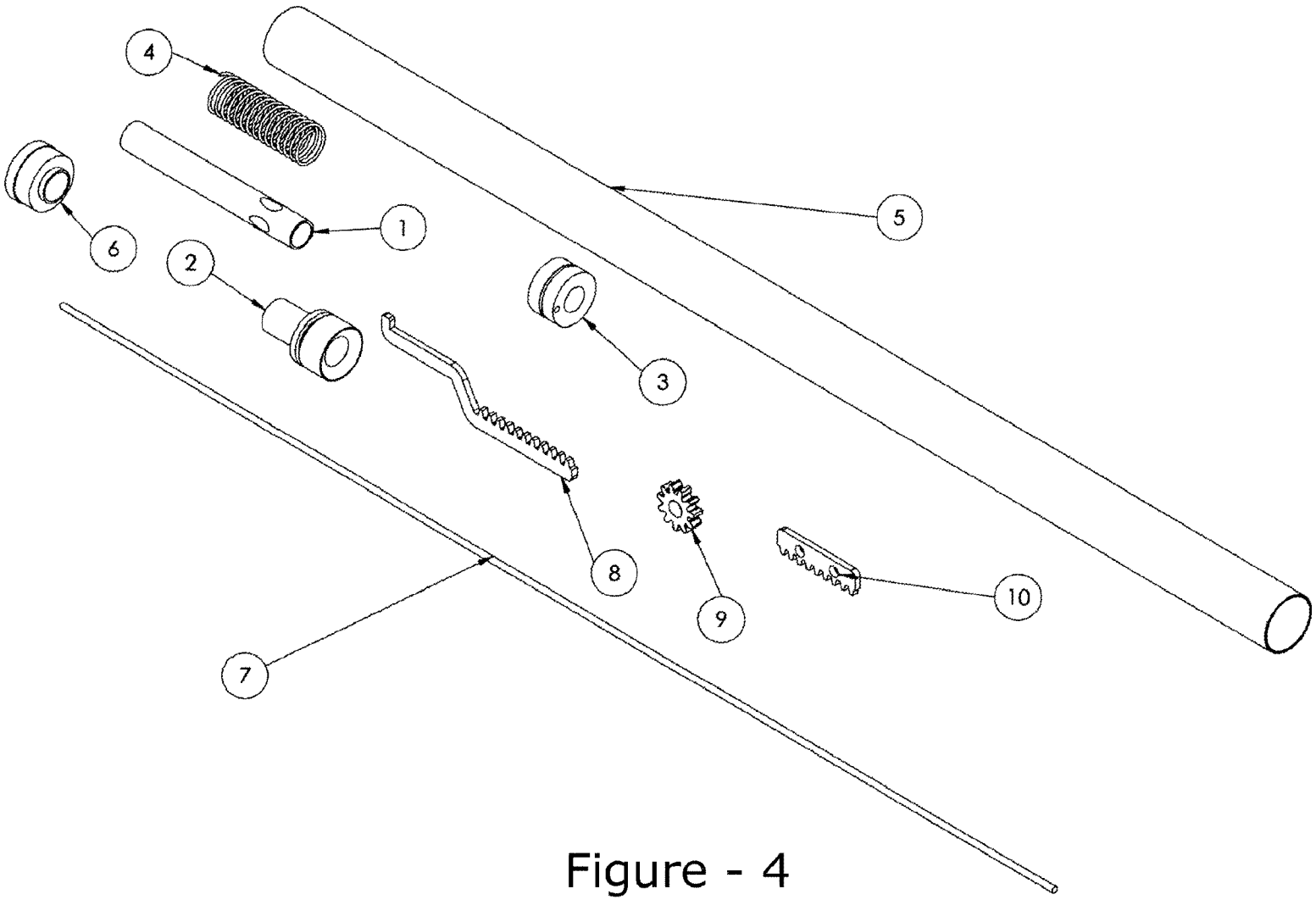

FIG. 4: A view illustrating altogether the members that constitute the system The members constituting the system are individually assigned with reference numerals to enable the operating system of the rifle or the pistol to be understood.

1—Piston carrying body
2—Piston
3—Sealing mount
4—Motion spring
5—Barrel sleeve
6—Sleeve cover
7—Motion transmitting pin
8—Rack motion plate
9—Gear wheel
10—Rack mechanism In the semi-automatic air rifle and air pistol with pneumatic system (PCP) according to the invention, the mechanism is cocked only during the first shot. When the trigger is pulled, some of the air inside the air cylinder is enabled to be transferred to the barrel. The transferred air advances along the barrel to enable the ammunition to leave the barrel and reach the target. In the meantime, when the pressurized air is about the leave the barrel along with the ammunition, some of said air passes through the holes drilled according to certain angles in the direction of the air on the piston carrying body (1) and fills into the compartment within the barrel sleeve (5). The air, which becomes compressed owing to the sealing mount (3), is not able to escape backwards and it thus hits the piston (2) with all its power to push said piston forward. In this way, the velocity of the air carrying the ammunition is fully utilized. Meanwhile, the motion spring (4) imparting pressure on the piston becomes compressed to a certain extent between the piston (2) and the sleeve cover (6). Together with the piston, the motion transmitting pin (7) and the rack motion plate (8), which are linked to said piston, also move in the front direction. Meanwhile, the gear wheel (9), which operates in harmony with the rack motion plate (8), moves the rack mechanism (10), which is coupled with the same, in the opposite direction while said gear wheel rotates about its axis, thereby enabling the rifle or the pistol to be automatically cocked after the shot. When the pressure on the piston is removed, the compressed motion spring (4) brings the piston (2) and thus all the system members connected to the same back to their original positions before the shot.

Every time the trigger is pulled, these actions are repeated and every time the rifle or the pistol automatically prepares itself for the next shot.

As mentioned above, there is no need for extra energy for the automatic operation of the rifle or the pistol. The idle air carrying the ammunition is caused to directly hit the piston without any change in the direction of movement of said air and thus, the rifle or the pistol is enabled to operate in an automatic manner. According to the system we have developed, since the air is caused to hit the piston without any change in the direction of said air, the rifle or pistol becomes capable of operating even at smaller pressures and showing better performance than its counterparts.

What is claimed is:

1. A semi-automatic air rifle with a pneumatic system, enabling the semi-automatic air rifle to automatically prepare after each shot, comprising the following component parts:

a piston carrying body comprising angled through-holes;
a piston;
a sealing mount;
a motion spring;
a barrel sleeve;
a sleeve cover;
a motion transmitting pin;
a rack motion plate; a gear wheel; and
a rack mechanism, wherein said component parts are arranged with respect to each other so as to enable an air inside the semi-automatic air rifle carrying a fired ammunition emerges from a muzzle of the semi-automatic air rifle to pass through the through-holes and directly hit the piston without any change in the direction of motion of the air; and the piston is set in motion towards the muzzle as well as to enable other component parts linked with the piston to become actuated so that the semi-automatic air rifle is enabled to automatically prepare itself for the next shot following each shot.

* * * * *